US005207940A

United States Patent [19]

Carpenter et al.

[11] Patent Number: 5,207,940

[45] Date of Patent: May 4, 1993

[54] α-OLEFIN OLIGOMER-PHENOL LUBRICANT OIL ADDUCTS

[75] Inventors: Joel F. Carpenter; Jerry M. Roper, both of Baton Rouge, La.

[73] Assignee: Ethyl Corporation, Richmond, Va.

[21] Appl. No.: 835,103

[22] Filed: Feb. 12, 1992

Related U.S. Application Data

[63] Continuation of Ser. No. 581,540, Sep. 12, 1990, abandoned.

[51] Int. Cl.[5] ..... C10M 105/06

[52] U.S. Cl. ..... 252/52 A; 252/54; 252/52 R

[58] Field of Search ..... 252/52 A, 52 R, 54

[56] References Cited

U.S. PATENT DOCUMENTS

| | | | |
|---|---|---|---|
| 2,180,008 | 11/1939 | Lincoln | 252/54 |
| 3,793,351 | 2/1974 | McCoy | 252/52 A |
| 3,808,134 | 4/1974 | Romine | 252/59 |
| 3,812,036 | 5/1974 | Romine | 252/59 |
| 3,933,662 | 1/1976 | Lowe | 252/52 A |
| 4,035,308 | 7/1977 | Schenach | 252/59 |
| 4,238,343 | 12/1980 | Pellegrini, Jr. | 585/24 |
| 4,358,386 | 11/1982 | Zoleski | 252/51.5 A |
| 4,708,809 | 11/1987 | Davis | 252/33.4 |
| 4,744,912 | 5/1988 | Cardis | 252/46.7 |
| 4,855,075 | 8/1989 | Casciani | 568/608 |
| 4,933,485 | 6/1990 | Buckley, III | 560/159 |
| 4,973,414 | 11/1990 | Nerger | 252/52 A |

FOREIGN PATENT DOCUMENTS

| | | |
|---|---|---|
| 1207315 | 7/1986 | Canada . |
| 288777 | 2/1988 | European Pat. Off. . |
| 0377305 | 7/1990 | European Pat. Off. . |
| 2512054 | 3/1982 | France . |
| 0639850 | 4/1979 | U.S.S.R. . |
| 0581783 | 10/1946 | United Kingdom . |
| 0632990 | 12/1949 | United Kingdom . |
| 1212462 | 11/1970 | United Kingdom . |

*Primary Examiner*—Jacqueline V. Howard
*Attorney, Agent, or Firm*—David M. Bunnell

[57] ABSTRACT

A synthetic oil composition comprising the reaction product of an α-olefin oligomer derived from an α-olefin monomer containing from about 6 to 20 carbon atoms and from about 0.01 to 1 mole of a phenol per mole of oligomer. The oil composition can be further reacted to form alkoxylated products and can be mixed with polar additives to form homogeneous synthetic lubricants.

17 Claims, No Drawings

α-OLEFIN OLIGOMER-PHENOL LUBRICANT OIL ADDUCTS

This application is a continuation of application Ser. No. 581,540, filed Sep. 12, 1990, now abandoned.

BACKGROUND

This invention relates generally to synthetic lubricant compositions and more particularly to synthetic oils which are adducts of alpha-olefin oligomers and phenol and lubricant compositions formed using such oils.

Alpha-olefin oligomers (PAOs) derived from $C_6$ or higher alpha-olefin monomers and their use as functional fluids and synthetic lubricants are well known. Such oligomers are usually hydrogenated to improve their oxidation resistance and are known for their superior properties of long-life, low volatility, low pour points and high viscosity indexes which make them a premier basestock for state-of-the-art lubricants and hydraulic fluids. A problem associated with such basestocks is that polar lubricant additives are generally less soluble in PAOs than in mineral oils. We have found that the PAOs can be made more compatible with polar additives by the presence of PAO-phenol adducts. Alkoxylated derivatives of the adducts are expected to further improve the compatibility properties of the PAOs.

BRIEF SUMMARY

In accordance with this invention there is provided a synthetic oil comprising the reaction product of an alpha-olefin oligomer derived from an α-olefin monomer containing from about 6 to 20 carbon atoms and from about 0.01 to 1 mole of a phenol or an alkoxylated phenol per mole of oligomer.

Also provided is a lubricant composition comprising (i) a major portion by weight of an alpha-olefin oligomer derived from an α-olefin monomer containing from about 6 to 20 carbon atoms, which oligomer contains from about 0.01 to 1 mole of phenol or alkoxylated phenol groups per mole of oligomer, and (ii) a minor portion of at least one polar lubricant additive.

DETAILED DESCRIPTION

The preparation of alpha-olefin oligomers is well known. For example, U.S. Pat. No. 3,113,167 describes an α-olefin oligomer process using a titanium halide and an aluminum compound as the oligomerization catalyst.

Other suitable catalysts for making α-olefin oligomers are Friedel-Crafts catalysts such as boron trifluoride ($BF_3$) as disclosed in U.S. Pat. No. 3,149,178. Optimum lubricant properties are obtained starting with 1-decene although mixtures of α-olefins have been used cf. U.S. Pat. No. 3,330,883. Pure $BF_3$ is not an effective oligomerization catalyst. A small amount of polar compound is necessary as a promoter. U.S. Pat. No. 3,382,291 describes the use of alcohol promoters such as decanol. Alcohols containing about 1–8 carbon atoms such as methanol, ethanol, isopropanol, n-propanol, n-butanol, isobutanol, n-hexanol and n-octanol can also be used. A preferred promoter is n-butanol. Other promoters include, for example, mordenite (hydrogen form), water, phosphoric acid, fatty acids (e.g. valeric acid), aldehydes, ketones, organic esters, ethers, polyhydric alcohols, silica gel and the like.

The amount of promoter is an amount that causes the $BF_3$ to act as an oligomerization catalyst. A useful range is about 0.1–2.0 weight percent of the α-olefin.

Methods of conducting a $BF_3$ catalyzed oligomerization process are well-known. In one mode, $BF_3$ is merely bubbled through the α-olefin reaction mixture containing a promoter during the oligomerization. Generally, the process is conducted under $BF_3$ pressure. A useful pressure is about 1–100 psig and especially 5–50 psig.

Alpha-olefins most useful in preparing synthetic base oils are mainly linear terminal olefins containing about 8–12 carbon atoms such as 1-octene, 1-decene, 1-dodecene and the like including mixtures thereof. The most preferred α-olefin is 1-decene or an olefin mixture containing mainly, for example, at least 75 weight percent 1-decene.

Generally, reaction temperatures are about 20°–50° C. and especially about 25°–40° C.

The oligomer products are mixtures which include amounts of dimer, trimer, tetramer, pentamer and higher oligomers of the monomer, depending upon the particular α-olefin, catalyst and reaction conditions. The products are unsaturated and usually have viscosities ranging from about 2 to 100 cSt and especially 2 to 15 cSt at 100° C.

The product viscosity can be further adjusted by either removing or adding higher or lower oligomers to provide a composition having the desired viscosity for a particular application.

According to the invention the unhydrogenated PAOs are reacted with from about 0.01 to 1 moles of a phenol or an alkoxylated phenol per mole of PAO.

Suitable phenols can be represented by the formula:

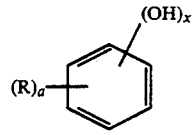

where x=1 or 2, a=0 to 3, and

R is a hydrocarbyl group or, when a is 2 or 3, the same or different hydrocarbyl groups and two R groups taken together with the carbons to which they are attached can form a 5 to 7 member ring.

Examples of hydrocarbyl groups include $C_1$ to about $C_{20}$ alkyl, benzyl, phenyl, naphthyl and the like. Examples of suitable phenol compounds include phenol, resorcinol, hydroquinone, catechol, cresol, xylenol, hydroxydiphenol, naphthol, benzylphenol, alpha and beta methylnaphthol and the like. The additional rings of the multicyclic compounds can be further substituted with hydrocarbyl groups. The preferred phenol is phenol. Mixtures of phenols can be used.

The reaction of the PAO and phenol or alkoxylated phenol is catalyzed with certain acid catalysts including triflic acid and $BF_3$. Effective amounts of catalyst range from about 0.05 to 10 wt % based on olefin starting material. The preferred reaction temperature is about 0° to 150° C. and more preferably, about 15° to 80° C.

The product, phenolized synthetic lubricant oils have increased viscosity. They can be used alone or in combination with other base oils of lubricating viscosity such as mineral oils, hydrogenated PAOs and synthetic esters to form lubricant compositions. The lubricant compositions generally contain up to about 99.5 wt % of either the PAO-phenol adduct alone, or a combination of PAO-phenol adduct and one or more other lubricant oils. The compositions also contain from about 0.5 to about 25 wt % based on the weight of lubricant composition of one or more lubricant additives which are added to provide the necessary performance properties for different lubricant applications as is well known in the art. For example, dispersants, anti-wear agents, friction reducers, viscosity index improvers, antioxidants, corrosion inhibitors, detergents, foam inhibitors, and the like. The phenolized PAOs have improved compatibility with polar additives such as sulfurized olefins, alkyl phosphates and thiophosphates, sulfonates, carbamates, amides, imides, etc. In a further aspect of the invention, when PAO-phenol adducts in amounts of from about 1 to 25 wt % based on the total weight of lubricant composition and, preferably, 10 to 20 wt %, are added to PAO base oils, they act as solubilizing agents or dispersants for the polar lubricant additives.

The polar nature of the synthetic oils of the invention can be further enhanced by alkoxylation of the hydroxyl group such as by reacting the PAO-phenol adduct with from about 1 to 100 mole of ethylene oxide or an equivalent amount of a haloalkoxylated alcohol such as 2-(2-chloroethoxy)ethanol per mole of adduct. Alternatively, an alkoxylated phenol can be reacted with the PAO to form the alkoxylated adduct directly.

The invention is further illustrated by, but is not intended to be limited to, the following examples.

EXAMPLE 1

A 250 mL three-neck round bottom flask was charged with 80.0 grams (0.148 mole) of unhydrogenated 6 cSt polyalphaolefin (pAO), 17.9 grams (0.186 mole) of phenol, and 3.6 grams of triflic acid. The reaction mixture evolved heat and darkened immediately. After stirring at ambient temperature for 100 hours under a stream of $N_2$, the reaction mixture was diluted with 200 mL of ether. This solution was washed with a portion each of saturated aqueous sodium bicarbonate and brine. The organic portion was then dried over potassium carbonate. The solvent was stripped, and the unreacted phenol was flashed out at 120° C. under high vacuum. The recovered, highly viscous oil (287 cSt/40° C., 16.5 cSt/100° C., VI 36) weighed 83.9 grams corresponding to a 90% yield. By proton NMR spectroscopy, the para-selectivity was 83%. The PAO starting material is a mixture of isomers and oligomers, and so the para-alkylated phenolic product is a mixture. Hence, the chemical shifts reported represent an approximate value of a group of similar absorptions. Only the aromatic region is reported.

For Para-PAO Phenol $^{13}$CNMR (75 MHz, $CDCl_3$, TMS): 153, 141, 128, 115.

$^{1}$H NMR (300 MHz, $CDCl_3$, TMS): 7.1 (m, 2H), 6.7 (dm, 2H).

EXAMPLE 2

A 100 mL flask was charged with 10.0 grams (18.4 mmol) of unhydrogenated 6 cSt polyalphaolefin (PAO), 2.0 grams (21 mmol) of phenol, and 0.18 grams of boron trifluoride. The reaction mixture darkened immediately. After stirring at ambient temperature for 20 hours, the reaction mixture was diluted with 30 mL of heptane. This solution was washed with a portion of 10% aqueous ammonium hydroxide then filtered through cotton and evaporated. The unreacted phenol was flashed out at 120° C. under high vacuum. The recovered, highly viscous oil weighed 11.6 grams corresponding to a 94% yield. By proton NMR spectroscopy, the para-selectivity was 87%.

EXAMPLE 3

A 100 mL flask was charged with 10.0 grams (18.4 mmol) unhydrogenated 6 cSt polyalphaolefin (PAO), 2.24 grams (23.8 mmol) phenol, and 0.36 gram of triflic acid. The reaction mixture darkened immediately. After stirring at ambient temperature for 48 hours under a stream of $N_2$, the mixture was heated at 80° C. for 24 hours more. The product mixture was worked up as in Example 1, flashing off the unreacted phenol at 150° C. under high vacuum. By carbon and proton NMR spectroscopies, a gross mixture of C-alkylation regio-isomers were detected.

EXAMPLE 4

A 50 mL round bottom flask was charged with 4.90 grams (23.8 mmol) of 2,6-di-t-butylphenol, 10.0 grams (18.4 mmol) unhydrogenated 6 cSt polyalphaolefin (PAO), and 0.44 gram triflic acid. The reaction mixture evolved heat and darkened immediately. After stirring at ambient temperature for 24 hours under a stream of $N_2$, an aliquot was taken. By proton NMR spectroscopy, only starting materials were detected. The reaction mixture was heated at 80° C. for 16 hours more. It was then worked up as in Example 1. The unreacted phenolics were flashed off by heating at 150° C. under a high vacuum. A gross mixture of products was detected by carbon and proton NMR spectroscopies. A significant portion of the mixture was unsubstituted at either the 2 or 6 positions—as indicated by the absorptions that were observed at 112–116 ppm in the CMR spectrum. This alkylation was accompanied by significant de-alkylation of the ortho-t-butyl substituents.

EXAMPLE 5

A PAO-phenol adduct prepared according to the procedure of Example 1 (0.514 gram, 1.0 mmol), 0.27 gram Na (1.17 mmol) and 10 grams of toluene were charged to a 50 ml flask and heated with stirring at 80° C. for 18 hours. The sodium remained, so the temperature was increased to 112° C. After 5 hours all of the sodium had reacted, and 0.12 ml of 2-(2-chloroethoxy)ethanol (1.4 mmol) were added and the mixture stirred overnight. After stripping and work-up a yellow oil was recovered which by NMR was a 73/27 mixture of ethoxylate product and unreacted adduct.

EXAMPLE 6

A 100 mL flask was charged with 10.0 grams (34.7 mmol) unhydrogenated 2 cSt polyalphaolefin (PAO), 3.3 grams (35 mmol) phenol, and 0.18 gram boron trifluoride. The reaction mixture darkened immediately. After stirring at ambient temperature for 20 hours, the reaction mixture was diluted with 50 mL methylene chloride. This solution was washed with a portion each of 10% aqueous ammonium hydroxide and then brine. It was dried over anhydrous sodium sulfate, filtered through cotton, and evaporated. The unreacted phenol was flashed out at 150° C. under high vacuum. The recovered highly viscous oil weighed 11.8 grams corresponding to a 89% yield. By proton NMR spectroscopy, the para-selectivity was 86%. The PAO starting material is a mixture of isomers and oligomers, and so the para-alkylated phenolic product is a mixture.

Hence, the chemical shifts reported represent an approximate value of a group of similar absorptions. Only the aromatic region is reported.

For para-(2 cSt)PAO-Phenol $^1$H NMR (300 MHz, $CDCl_3$, TMS): 7.0 (m, 2 H), 6.7 (dm, 2 H).

PAO-Phenol as a Dispersant of SIB's in High Viscosity PAO's

For each run, an 8-dram vial was charged with the amounts set out in Table I below of HiTec 174 (40 cSt PAO), HiTec 309 SIB (sulfurized isobutylene), and the PAO-Phenol adduct prepared in Example 1, plus a Teflon coated magnetic stir bar. These vials were loosely sealed with a polyseal cap, and the contents were stirred at 300 rpm via a magnetic stirrer. After the indicated times at the indicated temperatures as set out in Table I, the vials were inspected, Group A was inspected visually, while Group B was inspected with a Hach Turbidity Meter.

TABLE I

| | 1 | 2 | 3 | 4 |
|---|---|---|---|---|
| Group A | | | | |
| wt PAO (g) | 9.53 | 9.08 | 8.54 | |
| wt SIB (g) | 0.51 | 0.55 | 0.50 | |
| wt PAO-Phenol (g) | — | 0.50 | 1.03 | |
| % PAO | 94.9 | 89.6 | 84.8 | |
| % SIB | 5.1 | 5.4 | 5.0 | |
| % PAO-Phenol | — | 5.0 | 10.2 | |
| Turbidity at 20 h/25° C. | cloudy | cloudy | clear | |
| Turbidity at 6 h/40° C. | sl. cldy. | sl. cldy. | clear | |
| Turbidity at 20 h/25° C. | cloudy | sl. cldy. | clear | |
| Group B | | | | |
| wt PAO (g) | 20.02 | 19.03 | 18.03 | 17.00 |
| wt SIB (g) | — | 1.01 | 1.01 | 1.01 |
| wt PAO-Phenol (g) | — | — | 1.03 | 2.03 |
| % PAO | 100 | 95.0 | 89.8 | 84.8 |
| % SIB | — | 5.0 | 5.0 | 5.0 |
| % PAO-Phenol | — | — | 5.1 | 10.1 |
| Turbidity at 20 h/25° C. (ntu)* | 0.2 | 92.2 | 37.5 | 7.3 |
| Turbidity at 6 h/40° C. then 20 h/25° C. (ntu) | 0.2 | 480 | 30.2 | 8.8 |

*ntu = nephelometer turbidity units where any value less than 10 is considered to be adequately dispersed.

The results show that the addition of about 5 wt % adduct improved the solubility of the SIB and that the addition of 10 wt % PAO-phenol adduct to the PAO provided for substantially complete solubility of 5 wt % of the polar SIB adduct.

PAO-Phenol Base Oil Plus SIB

Lubricating compositions were prepared and tested as for the Group A samples above to compare a mixture of a high viscosity PAO oil containing about 5 wt % SIB with a mixture containing the PAO-phenol adduct oil of Example 1 and about 5 wt % SIB. The compositons and results are set out in Table II.

TABLE II

| | 1 | 2 |
|---|---|---|
| wt PAO (g) | 8.53 | — |
| wt SIB (g) | 0.48 | 0.051 |
| wt PAO-Phenol (g) | — | 0.937 |
| % PAO | 94.7 | — |
| % SIB | 5.3 | 5.2 |
| % PAO-Phenol | — | 94.8 |
| Turbidity at 20 h/25° C. | cloudy | clear |
| Turbidity at 6 h/40° C. | cloudy | clear |
| Turbidity at 20 h/25° C. | cloudy | clear |

The results show that the SIB was soluble in the PAO-phenol oil but not in the PAO oil.

What is claimed is:

1. A synthetic oil which is a dispersant for polar lubricant additives comprising the alkylation reaction product of an α-olefin oligomer derived from an α-olefin monomer containing from 8 to 20 carbon atoms and prepared using a Friedel-Crafts catalyst and from about 0.01 to 1 mol of a phenol per mole of oligomer, which product has been reacted to convert at least a portion of the hydroxyl groups to alkoxylated alcohols.

2. A synthetic oil of claim 1 wherein, in converting at least a portion of said hydroxyl groups to alkoxylated alcohols, the product is reacted with from about 1 to 100 moles of ethylene oxide, or an equivalent amount of a haloalkoxylated alcohol, per mole of phenol.

3. The synthetic oil of claim 2 wherein the haloalkoxylated alcohol is 2-(2-chloroethoxy)ethanol.

4. The synthetic oil of claim 1 wherein the phenol is a compound having the formula:

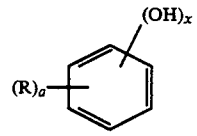

where x=1 or 2, a=0 to 3, and

R is a hydrocarbyl group or, when a is 2 to or 3, the same or different hydrocarbyl groups and two R groups taken together with the carbons to which they are attached can form a 5 to 7 member ring.

5. The synthetic oil of claim 4 wherein the phenol is phenol.

6. The synthetic oil of claim 1 wherein the α-olefin monomer contains from 8–12 carbon atoms.

7. The synthetic oil of claim 6 wherein the α-olefin monomer is 1-decene.

8. The synthetic oil of claim 1 wherein the α-olefin monomer is 1-decene.

9. The synthetic oil of claim 1 wherein the α-olefin oligomer has a viscosity of from about 2 to 100 cSt at 100° C.

10. A lubricant composition comprising (i) a major portion by weight of an α-olefin oligomer base oil derived from an α-olefin monomer containing from about 6 to 20 carbon atoms (ii) a minor portion by weight of at least one polar lubricant additive and (iii) a solubilizing agent for said additive, which solubilizing agent is the alkylation reaction product of an unhydrogenated α-olefin oligomer derived from an α-olefin monomer containing from 8 to 20 carbon atoms and prepared using a Friedel-Crafts catalyst and from about 0.01 to 1 mole of a phenol per mole of oligomer, which product has been reacted to convert at least a portion of the hydroxyl groups to alkoxylated alcohols.

11. The composition of claim 10 wherein the phenol is a compound having the formula:

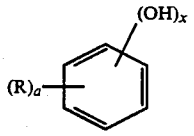

where x=1 or 2, a=0 to 3, and

R is a hydrocarbyl group or, when a is 2 to 3, the same or different hydrocarbyl groups and two R groups taken together with the carbons to which they are attached can form a 5 to 7 member ring.

12. The composition of claim 10 wherein said solubilizing agent is present in from about 1 to 25 wt % based on the total weight of lubricant composition.

13. The composition of claim 10 wherein said solubilizing agent is present in from about 10 to 20 wt % based on the total weight of lubricant composition.

14. The composition of claim 12 wherein said composition contains from about 0.5 to 25 wt percent of at least one polar lubricant additive.

15. The composition of claim 10 wherein said base oil is hydrogenated.

16. The composition of claim 10 wherein said α-olefin oligomer base oil has a viscosity of from about 2 to 100 cSt at 100° C.

17. The composition of claim 10 wherein said polar lubricant additive is sulfurized isobutylene.

* * * * *